US005132880A

United States Patent [19]

Kawamura

[11] Patent Number: 5,132,880

[45] Date of Patent: Jul. 21, 1992

[54] ILLUMINATED BUCKLE FOR VEHICLE SEAT BELT SYSTEM

[75] Inventor: Yoshihisa Kawamura, Shiga, Japan

[73] Assignee: Takata Corporation, Tokyo, Japan

[21] Appl. No.: 685,814

[22] Filed: Apr. 15, 1991

[30] Foreign Application Priority Data

Apr. 18, 1990 [JP] Japan ..... 2-102535

[51] Int. Cl.[5] ..... F21V 7/04

[52] U.S. Cl. ..... 362/32; 362/253; 280/801

[58] Field of Search ..... 362/32, 253, 61; 280/801

[56] References Cited

U.S. PATENT DOCUMENTS 4,933,818 6/1990 Eckmann ..... 362/32

*Primary Examiner*—Carroll B. Dority

*Attorney, Agent, or Firm*—Brumbaugh, Graves, Donohue & Raymond

[57] ABSTRACT

In an illuminated buckle for a seat belt system, the ejector component of the buckle is made of light-transmitting material, and an optical path for guiding light towards the ejector component is provided within the buckle. When the tongue is not inserted in the buckle, the light-transmitting ejector component is exposed outside the buckle and serves as an illuminated marker for insertion of the tongue into the buckle. When the tongue is inserted, the ejector component is shielded from the exterior of the buckle, and escape of the light from the buckle is prevented.

5 Claims, 3 Drawing Sheets

ILLUMINATED BUCKLE FOR VEHICLE SEAT BELT SYSTEM

BACKGROUND OF THE INVENTION

The present invention relates to an illuminated buckle for a seat belt system and, in particular, to an illuminated buckle suitable for the seat belt system provided on the front seat of a vehicle.

Seat belt systems are provided on the seats of vehicles for restraining the occupants in case of collision and for protecting them against secondary impacts against internal parts of the vehicle. Such seat belts are usually placed over an occupant's body by inserting a tongue on the belt into a buckle. During nighttime or in other conditions of poor visibility, however, it is sometimes difficult for the occupant to locate the buckle in a non-illuminated vehicle.

To overcome this problem, it has been proposed in the prior art to provide an illuminating device on the buckle to illuminate parts of the buckle so that they are visible in darkness. For example, Japanese Provisional Utility Model Publication No. 54-76818 discloses an arrangement to illuminate the pushbutton of the buckle. Japanese Patent Publications No. 55-30366 and No. 55-30367 and Japanese Utility Model Publications No. 57-22803 or No. 63-42809 disclose an arrangement to illuminate the inlet edge of the buckle. Japanese Provisional Patent Publication No. 48-49126 discloses an arrangement to selectively illuminate both of the foregoing components. Japanese Provisional Utility Model Publication No. 61-36469 describes an arrangement to furnish an illuminating device within the ejector of the buckle.

In all of these conventional arrangements, however, the illuminating source, such as an electric bulb, LED, etc., is incorporated into the buckle. This results in problems of durability and maintenance inasmuch as trouble may occur due to overheating, wire disconnection, etc. It is particularly desirable to eliminate or minimize maintenance of the illumination components of the seat belt system, since such maintenance and the attendant risk of mistaken or negligent repair causes inconvenience and possible injury to the occupant in practice.

SUMMARY OF THE INVENTION

It is an object of the present invention to provide an illuminated buckle for a seat belt system which requires no electrical switch operation, causes neither overheating nor wire disconnection, exhibits high durability, and requires little or no maintenance.

The foregoing and other objects are attained, in accordance with the invention, by the provision of an illuminated buckle for a seat belt system in which the belt buckle includes a component made of light-transmitting material, which component is visible to the occupant when the belt is not in use but which is shielded from view when the tongue is inserted into the buckle. In a preferred embodiment, the light-transmitting component comprises a portion of the ejector mechanism and light is guided to the light-transmitting component via an optical path located in the buckle.

Thus, when the tongue is not inserted into the buckle, the light-transmitting buckle component is exposed outside the buckle and provides an illuminated marker for insertion of the tongue. When the tongue is inserted, the lighted component is shielded within the buckle and the escape of light to the outside is prevented.

For a better understanding of the invention, reference may be-made to the following description of an exemplary embodiment, taken in con]unction with the accompanying drawings.

DESCRIPTION OF THE EMBODIMENT

Figure 1:
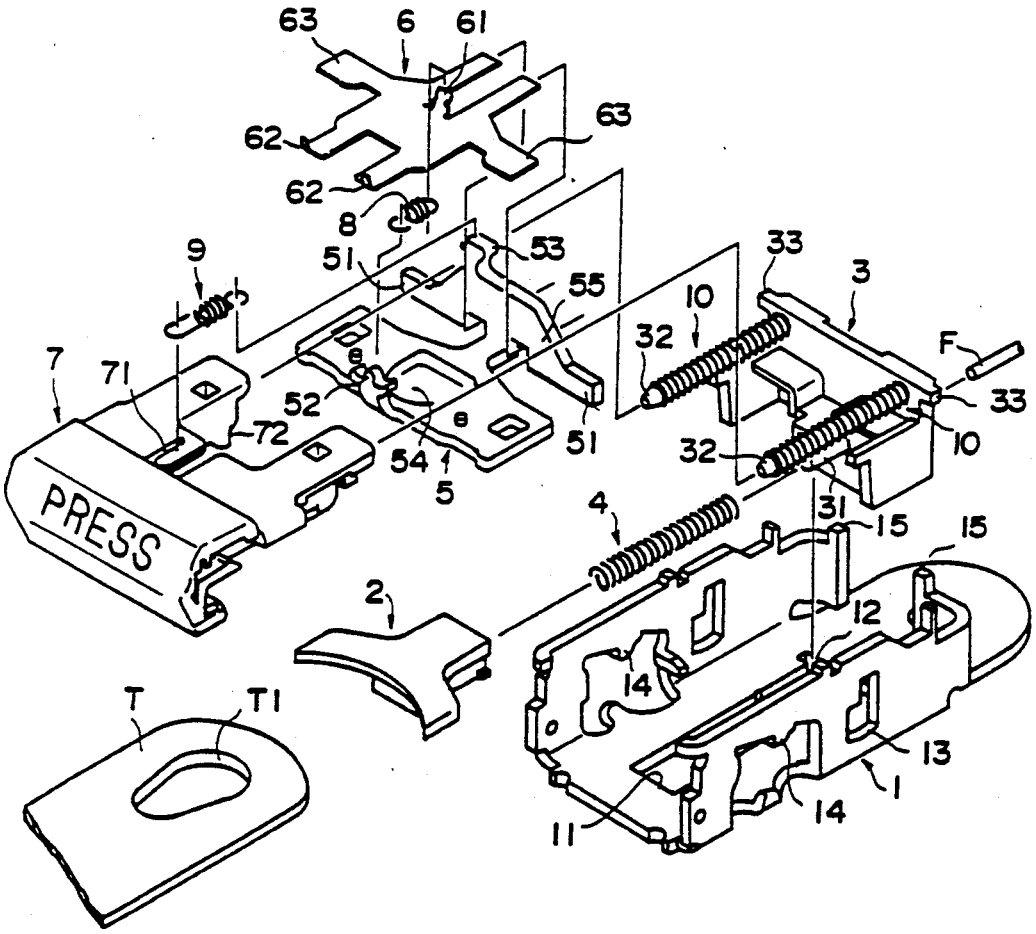
FIG. 1 is an exploded perspective view showing one embodiment of the internal structure of the buckle according to the present invention.

In the embodiment of FIG. 1, the buckle comprises a buckle base in the form of a channel 1 (hereinafter referred to as "base"), an ejector 2 engaged in a longitudinal slit 11 formed in the bottom wall and sliding in longitudinal direction along the base 1, a spring holder 3 with its lower projection engaged in a lateral slit 12 continuous to the rear end of the longitudinal slit 11 of the base 1. (Hereinafter, the stalk side of the buckle is called "rear" and the pushbutton side is called "front" for clarity in describing the structure and operation of the buckle.) The spring holder 3 includes left and right projections 33 at its rear end which engage the rear wall projections 15 on the base 1. A push-out spring 4 fits over a shaft 31 protruding in longitudinal direction from the spring holder 3, with one end of the spring 4 being supported in the front surface of the spring holder 3 and the other end thereof being received within and supported by a longitudinal bore in the ejector 2 (see FIG. 4). A latch plate 5 with pivotal arm 51 is engaged in the lateral wall opening 13 of the base 1 and is movably mounted on the base 1, being held by the front edge of the spring holder 3 for latching engagement with the tongue T. A lock plate 6 is supported by overlapping on the upper surface of the latch plate 5. A pushbutton 7 fits over the latch plate 5 and the lock plate 6, a tension spring 8 extends between the front projection 52 of the latch plate 5 and the rear projection 61 of the lock plate 6, and a tension spring 9 extends between the spring support projection 71 on the upper surface of the pushbutton 7 and the rear projection 53 of the latch plate 5. Compression return springs 10 have one end thereof engaged over the shafts 32 protruding forward from the spring holder 3 and in contact with the front surface of the spring holder 3 and the other end thereof in contact with the bottoms of rearly opening bores in the pushbutton 7. An optical fiber F is provided to guide light to the ejector 2 as described more fully below In FIG. 1, the buckle cover and supporting stalk as well as the connecting mechanisms for those components are not shown for clarity of illustration.

In the embodiment of FIG. 1, the illuminated buckle component is the ejector 2. A light-transmitting optical path in the buckle leading to the ejector 2 is forced through the optical fiber F, spring holder 3, and space in the base 1. This optical path is shown more clearly in FIG. 2.

Figure 2:
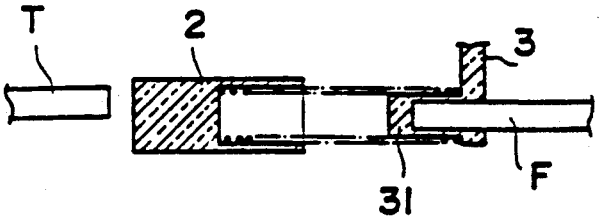
FIG. 2 is a partial schematic cross-sectional view of the light-transmitting components of the embodiment of FIG. 1.

As illustrated in FIG. 2, the ejector 2 is made of light-transmitting material such as a transparent plastic. The tip of the optical fiber F is guided from the buckle stalk (not shown) into the shaft 31 of the spring holder 3, which is also made of light-transmitting material. The inner end of the optical fiber F is thus supported in face-to-face relation to the bottom surface of the bore in the ejector 2 which receives the spring 4. The base or outer end of the optical fiber F is connected to a light source located at an arbitrary position outside the buckle, and preferably is led to the buckle through the buckle stalk.

Figure 3:
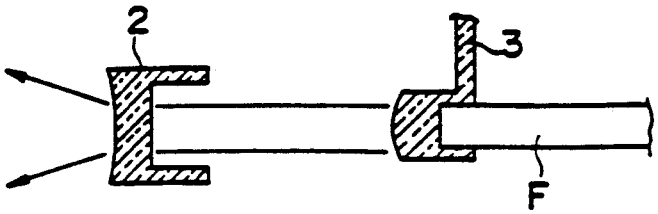
FIG. 3 is a partial enlarged cross-sectional view of the components of the optical path formed in the buckle of FIG. 1.

In the embodiment of FIG. 3, the front surface of the ejector 2 is concave in configuration while the front surface of the spring holder 3 is convex in configuration. The spring holder 3 thus serves as a convex lens to converge the light coming through the end surface of the optical fiber F and the ejector 2 acts as a concave lens to diffuse the received light. The light emitted from the tip of the optical fiber F is thereby guided toward the ejector 2 through the optical path in the buckle and diffused outwardly therefrom as indicated by the arrows in FIG. 3. Thus, the light can be transmitted from the spring holder 3 acting as a fixed component without requiring special connecting means on the ejector 2 acting as a movable component, and a very simple illumination mechanism is provided.

Figure 4A:
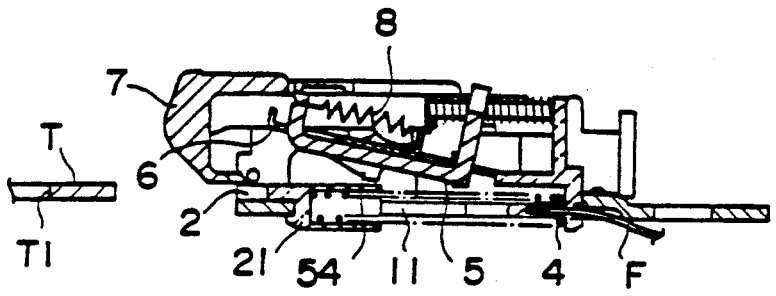
FIGS. 4A and 4B are cross-sectional views showing the buckle of FIG. 1 with the tongue removed and inserted, respectively.

As depicted in FIG. 4A, when the tongue T is not inserted in the buckle, the front surface of the sliding segment 21 of the ejector 2 is at the most forward position and in contact with the front end of the longitudinal slit 11. In this condition, the latch plate 5 is pushed upward by engagement of the projection 54, which upon insertion of the tongue T engages with the opening T1 of the tongue T, with the upper surface of the ejector 2. The lock plate 6 is moved backward against the force of the tension spring 8, and the front edge of the wing portion 63 is in contact with the rear cam surface of the projection 14, which protrudes downward from the edge of the opening formed on the lateral wall of the base 1 (see FIG. 1). In this position of the ejector 2, the front surface thereof diffuses the light externally of the buckle thereby enabling the occupant readily to find the buckle and insert the tongue even in darkness.

Figure 4B:
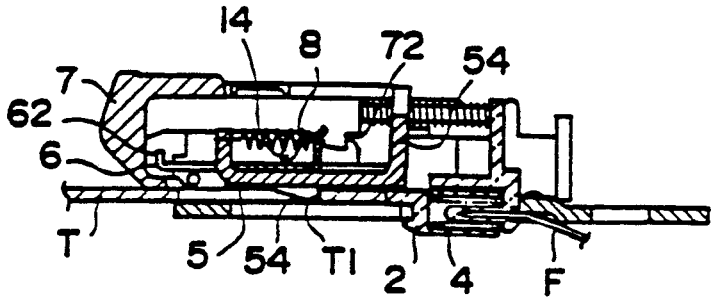

When the tongue T is inserted in the buckle, as shown in FIG. 4B, the ejector 2 is engaged by the front edge of the tongue T and moves backward against the force of the push-out spring 4. When the edge of the opening T1 of the tongue T moves beyond the position of the lower projection 54 of the latch plate, the restraint of the upward movement of the latch plate 5 to hinder forward movement of the lock plate 6 is released. The lock plate 6 is urged forward by the tension spring 8 and the front edge of the wing 63 of the lock plate 6 rides over the rear cam surface and the front side of the latch plate 5 is pushed down and is moved counterclockwise. The lower projection 54 of the latch plate 5 enters the opening T1 of the tongue T, engages with the edge of the opening T1 and holds the tongue in the locked position. Thus, when the tongue T is inserted, the ejector 2 is pushed deep into the base 1. Although the front surface of the ejector continues to emit light, the light does not escape from the buckle as it is shielded by the tongue T.

When the pushbutton 7 is pushed to remove the tongue from the locked condition, the rear surface of the pushbutton is brought into contact with the front edge 62 of the lock plate 6 and moves the lock plate 6 backward against the force of the tension spring 8. When the front edge of the wing 63 reaches the position to be separated from the projection 14, the projection 72 of the pushbutton 7 strikes the vertical wall 55 of the rear end of the latch plate 5, which causes the latch plate 5 to pivot clockwise around the pivotal arm 51. The engagement of the opening T1 of the tongue T with the projection 54 is thereupon released and the ejector 2 is urged forward by the push-out spring 4 to eject the tongue T from the buckle. As a result of this action, the front surface of the ejector 2 is again exposed outside the buckle, whereupon the insertion position of the tongue is directly illuminated so that it can be visually confirmed. This is the condition as shown in FIG. 4A.

Figure 5:
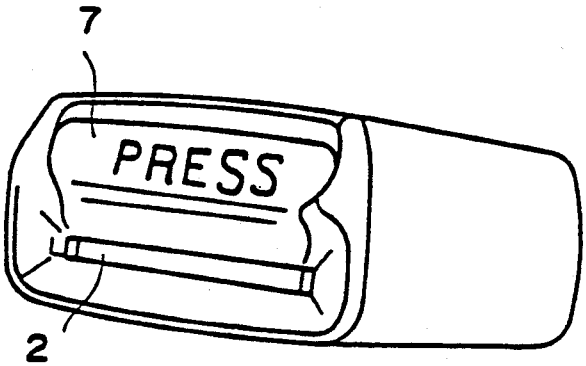
FIG. 5 is a perspective view showing the external appearance of one embodiment of the buckle according to the invention.

According to the foregoing embodiments, the ejector 2 itself, into which the tongue is to be inserted, emits the light as shown in the external view of FIG. 5. As a result, the tongue can be easily inserted, and the ejector 2 is automatically illuminated or not illuminated when the tongue is inserted to or withdrawn from, as the case may be, the buckle. As shown in FIGS. 1, 2 and 3, the spring holder 3 is preferably used as a support for the optical fiber F, whereby the present invention can be readily implemented without any substantial change in the structure or operation of a conventional type buckle.

Although the invention has been described hereinabove by reference to specific embodiments thereof, it will be understood that such embodiments are susceptible of modification and variation without departing from the inventive concept disclosed. For example, the base 1 instead of the spring holder 3 may be used to support the tip of the optical fiber F. Also, by forming irregularities on the irradiated surface of the ejector 2, the light may be diffused by irregular reflection for decorative purposes or to enhance the visibility of the ejector.

I claim:

1. In an illuminated buckle for a seat belt system including an ejector mechanism for permitting insertion of a seat belt tongue within said buckle to engage said buckle and tongue in locked relation to one another, the ejector mechanism including a movable ejector engaging said tongue for ejecting said tongue from said buckle upon release of said buckle and tongue from said locked relation, the improvement wherein a portion of said ejector that is visible outside said buckle when said tongue is not inserted in the buckle is composed of light-transmitting material, and wherein there is means within said buckle for transmitting light to said light-transmitting portion of said ejector, whereby said light-transmitting portion of the ejector constitutes an illuminated guide that facilitates locating said buckle for inserting said tongue.

2. The improvement according to claim 1 wherein the light is transmitted by the light-transmitting means to said light-transmitting portion of the ejector through an optical path located at least in part within said buckle.

3. The improvement according to claim 2 wherein said optical path includes an optical fiber coupling said buckle to an external light source.

4. The improvement according to claim 3 wherein said optical path comprises a first light-transmitting member coupled to said optical fiber and having a convexly curved light-transmitting surface facing said light-transmitting ejector portion such as to direct light onto said ejector portion.

5. The improvement according to claim 4 wherein the outer surface of said light-transmitting ejector portion is concavely shaped so as to diffuse the light outwardly away from said buckle.

* * * * *